US006739867B2

(12) United States Patent
Puig-Grós

(10) Patent No.: US 6,739,867 B2
(45) Date of Patent: May 25, 2004

(54) HOUSEHOLD LIGHTER WITH PIEZOELECTRIC IGNITION MECHANISM

(75) Inventor: Juan Lucas Puig-Grós, Barcelona (ES)

(73) Assignee: Flamagas SA (ES)

( * ) Notice: Subject to any disclaimer, the term of this patent is extended or adjusted under 35 U.S.C. 154(b) by 0 days.

(21) Appl. No.: 10/343,579

(22) PCT Filed: Mar. 22, 2002

(86) PCT No.: PCT/ES02/00148

§ 371 (c)(1),
(2), (4) Date: Jan. 30, 2003

(87) PCT Pub. No.: WO02/077531

PCT Pub. Date: Oct. 3, 2002

(65) Prior Publication Data

US 2003/0143505 A1 Jul. 31, 2003

(30) Foreign Application Priority Data

Mar. 23, 2001 (ES) ..... P200100691

(51) Int. Cl.[7] ..... F23D 11/36
(52) U.S. Cl. ..... 431/153; 431/255
(58) Field of Search ..... 431/153, 255, 431/344, 345, 277; 222/153.14

(56) References Cited

U.S. PATENT DOCUMENTS 5,697,775 A 12/1997 Saito et al. ..... 431/153
5,967,768 A 10/1999 Saito et al.
6,050,810 A 4/2000 Huang
6,050,811 A 4/2000 Steio
6,135,762 A * 10/2000 Hu ..... 431/255
6,135,763 A 10/2000 Man ..... 431/153
6,168,420 B1 * 1/2001 Sung ..... 431/255
6,325,617 B1 * 12/2001 Sung ..... 431/255
6,468,070 B1 * 10/2002 Jon ..... 431/255
2001/0044085 A1 11/2001 Sung

FOREIGN PATENT DOCUMENTS

WO 01/51855 7/2001

* cited by examiner

*Primary Examiner*—James C. Yeung
(74) *Attorney, Agent, or Firm*—Ostrolenk, Faber, Gerb & Soffen, LLP

(57) ABSTRACT

Of the type of lighters that have a gas tank (1) equipped with an exit valve (2) leading to a burner (6), where a push-button (15) simultaneously determines the opening of the valve (2) and the operation of a piezoelectric ignition generator (7), whose central characteristic is the incorporation of a track mechanism (16), operated by a second push-button (14) using the tension of a spring (20), so that said track mechanism can stop the functioning of the valve (2), in turn obstructing ignition, even though it acts on the push-button (15), which is necessary for the functioning of the lighter and simultaneously act on the push-buttons (14) and (15), thus producing ignition. The lighter has been designed to obstruct the manoeuvres necessary to produce ignition when in the hands of a child.

12 Claims, 6 Drawing Sheets

HOUSEHOLD LIGHTER WITH PIEZOELECTRIC IGNITION MECHANISM

DESCRIPTION

OBJECTIVE OF THE INVENTION

The present invention refers to a household lighter, more specifically a lighter with a piezoelectric ignition mechanism, of the type equipped with a fuel tank with a corresponding valve whose exit is connected to a burner via an elastic tube, which is situated inside one end of a decorative tube that also serves as a combustion chamber and has a push-button that allows both the opening of the valve and the operation of the piezoelectric mechanism to ignite the gas.

The objective of the invention is to obtain a household lighter equipped with a mechanism simple in conception and which guarantees safety, obstructing the manoeuvres necessary to ignite the lighter if used by young children, more specifically children younger than five years of age.

BACKGROUND OF THE INVENTION

U.S. Pat. No. 5,697,775 sets out safety mechanisms whose operation depends on jamming the push-button; this mechanism is incorporated into the push-button itself or is attached in the form of a second push-button. The different solutions claimed in this document have as an objective the obstruction of the movement of the push-button, with the result that it cannot act either on the piezoelectric or on the valve's opening mechanism.

The abovementioned embodiments holder the safety element on jamming the push-button. The various mechanisms claimed offer solutions, which are complex to a greater or lesser degree as far as the execution is concerned but when used as a jamming mechanism introduce a certain degree of uncertainty as far as the reliability of the system is concerned, whether this be due to the deterioration or even breakage of its components.

U.S. Pat. No. 6,135,763 sets out safety mechanisms whose operation depends on obstructing the opening of the valve unless a specific sequence of movements is carried out on the push-button. The various solutions claimed in this document have as an objective the obstruction of the action carried out on the valve's opening mechanism.

The abovementioned embodiment holders the operation on the absence of the application of an active force on the valve's opening mechanism, a situation obtained by means of an element incorporated into the push-button itself. Despite the fact that the solution claimed here is economical and simple to execute, one inconvenient aspect is the need to execute a two-fold operating manoeuvre on the double functional nature of the push-button when the latter moves freely on two perpendicular axes.

DESCRIPTION OF THE INVENTION

This invention's premise is to overcome the inconvenient aspects mentioned by means of mechanisms that block or obstruct its use by children.

The invention provides a lighter of the type described at the beginning, which is characterised in that it has an additional mechanism that acts as a safety element. The system is reliable, incapable of constant use without intervention from the user.

The invention holders its operation on a mechanism capable of creating a reaction force on the valve's opening mechanism.

The invention supposes that said force is created or eliminated according to the arming or disabling of the point of support on the lever defined by the tilting that is part of the maneuver necessary to open the valve.

One advantage of the invention is that this mechanism can be adapted to the majority of lighters currently available on the market; its manufacture would not involve any great modifications to lighters that lack a safety system and the investment that would be required is not very high.

In an initial preferred embodiment of the invention said mechanism is formed by an array of new elements that are actually part of the lighter. These elements are set up in their basic form through a secondary element that acts as a track mechanism perpendicularly to the main push-button and operated by a second push-button, this mechanism forming part of the actual push-button; the push-button can be moved by a finger pressing it, going from a dormant, resting position to a position where it acts as a point of support for the lever set up by the tilting; the push-button is equipped with a spring that forces the push-button to stand in a dormant support position once the operating force on the push-button has disappeared. The push-button can be made of metal or plastic independent of the structural characteristics of the design. This push-button is situated on the upper face of the holder of the lighter that houses all the elements of the latter.

In a second preferred embodiment of the invention said mechanism is formed by the same elements described in the preceding paragraph with the secondary push-button situated in either of the two side faces of the holder of the lighter.

In a third preferred embodiment of the invention said mechanism is formed by the same elements described in the first form outlined above, the difference being that the track mechanism is operated by a push-button that moves on a perpendicular axis to the former and acts on the mechanism by means of a cam with a contact surface of defined dimensions. This secondary push-button is located on the upper face of the holder of the lighter housing all the elements.

In a fourth preferred embodiment of the invention said mechanism is formed by the same elements described in the third form outlined above with the secondary push-button being situated on either of the two side faces of the holder of the lighter.

DESCRIPTION OF THE DRAWINGS

Other advantages and characteristics of the invention can be appreciated in the following description, which gives details of different embodiments of the invention, mention being made of the drawings attached that show the following.

PREFERRED EMBODIMENT OF THE INVENTION

Figure 1:
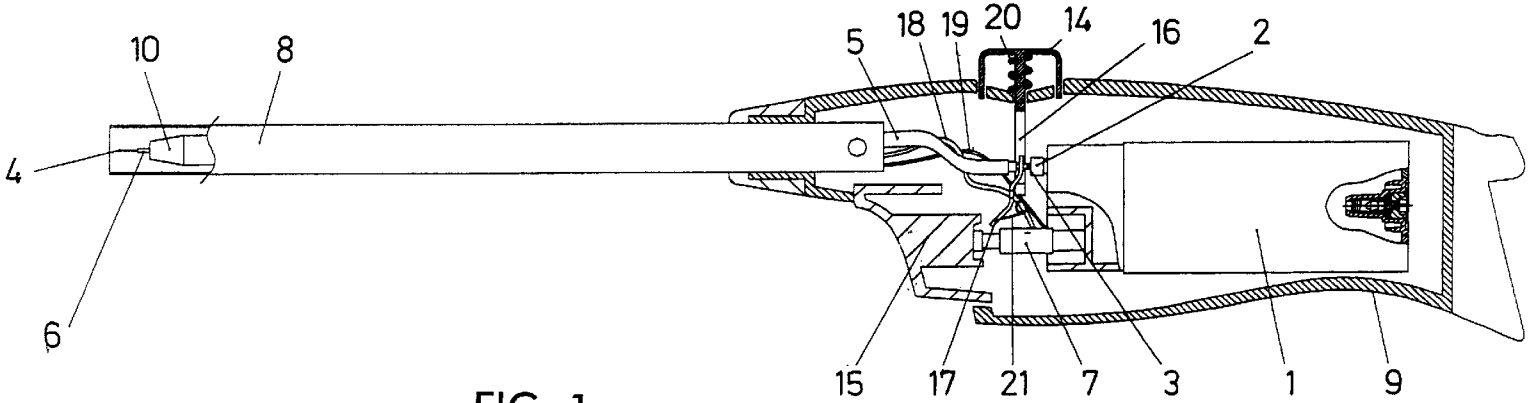
FIGS. 1 and 1A show two schematic views in cross section of a lighter made according to the objective of the present invention, and shown in symmetry.

The lighter in this invention is made up of a tank (1) for fuel and a valve (2) that regulates the opening and closing of the tank (1). This valve (2) is equipped with an exit mouth (3) that is joined by an elastic tube (5) to the burner (6) that fixes an exit level (4), which will be referred to further on.

In the embodiment laid out, the valve (2) is operated, as is customary, by means of a tilting (17) that also is operated by the push-button (15), which carries out the functions of transmitting force and movement between the finger and the tilting (17). Similarly, the push-button (15) acts as an element that transmits force and movement between the finger and the piezoelectric (7). There is also a metal tube (8) that is there for aesthetic reasons and to fasten the elements (10) that support the burner (9); likewise, this tube establishes the shape of the fuel tank and acts as a circuit and electrode in the piezoelectric lighting mechanism. As elements conducting electric current between the piezoelectric (7), the tube (8) has an electric conductor (18). There is also a second element (19) conducting electric current from the piezoelectric (7) and the burner (6), which also acts as a second electrode in the generation of the voltage arc.

Figure 3A:
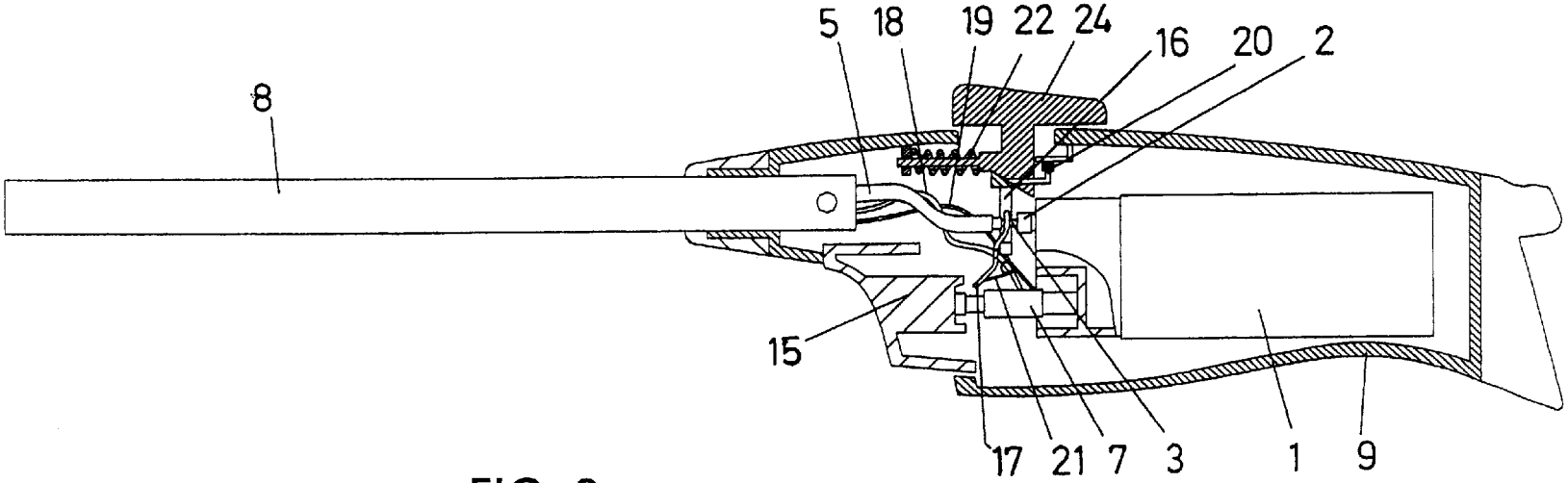
FIGS. 3 and 3A show simplified representations of the operating mechanism with the arming safety mechanism in its dormant position without a finger pressing the main push-button.
Figure 3:
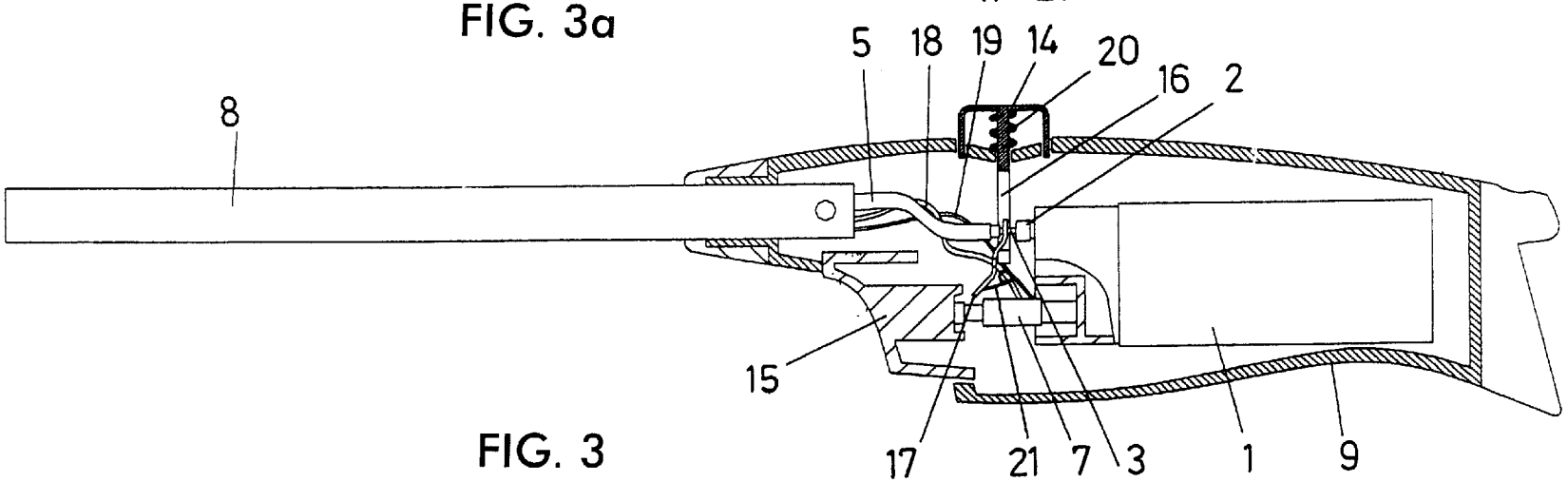
Figure 4:
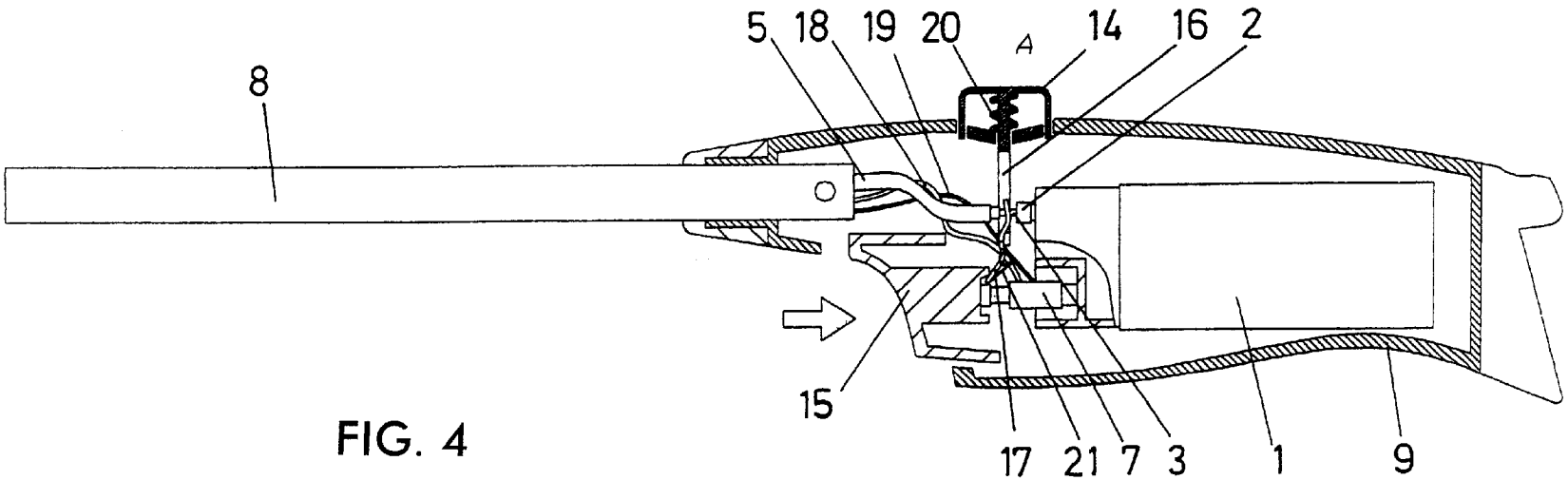
FIGS. 4 and 4A show simplified representation of the operating mechanism with the arming safety mechanism in its dormant position with a finger pressing the main push-button.
Figure 4A:
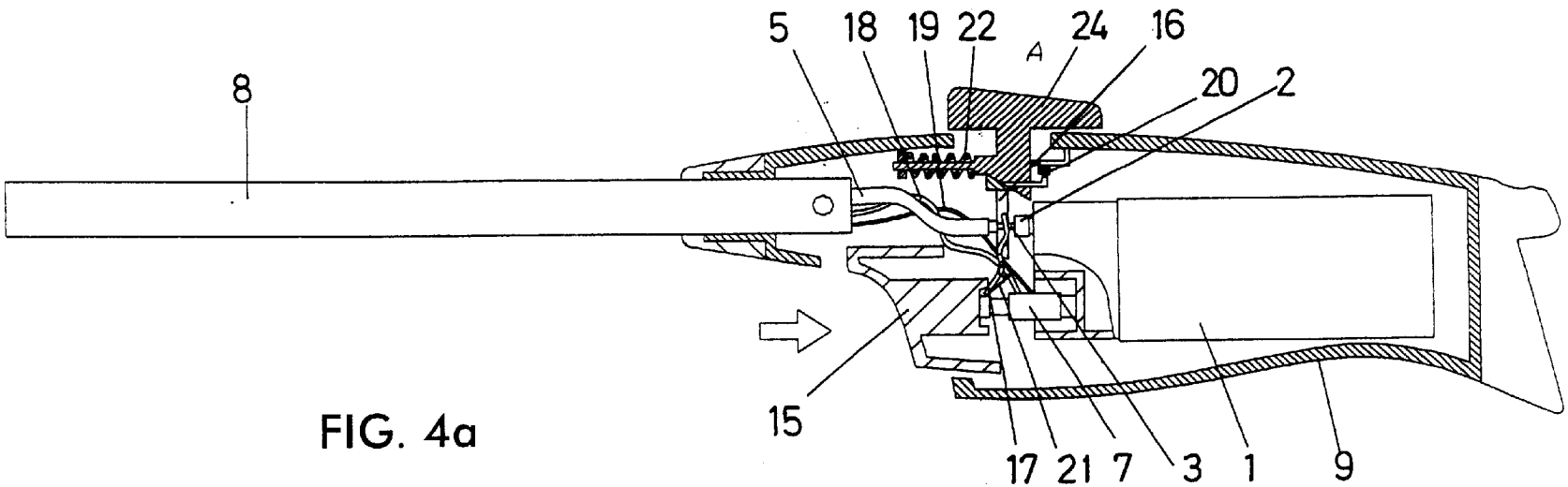
Figure 5:
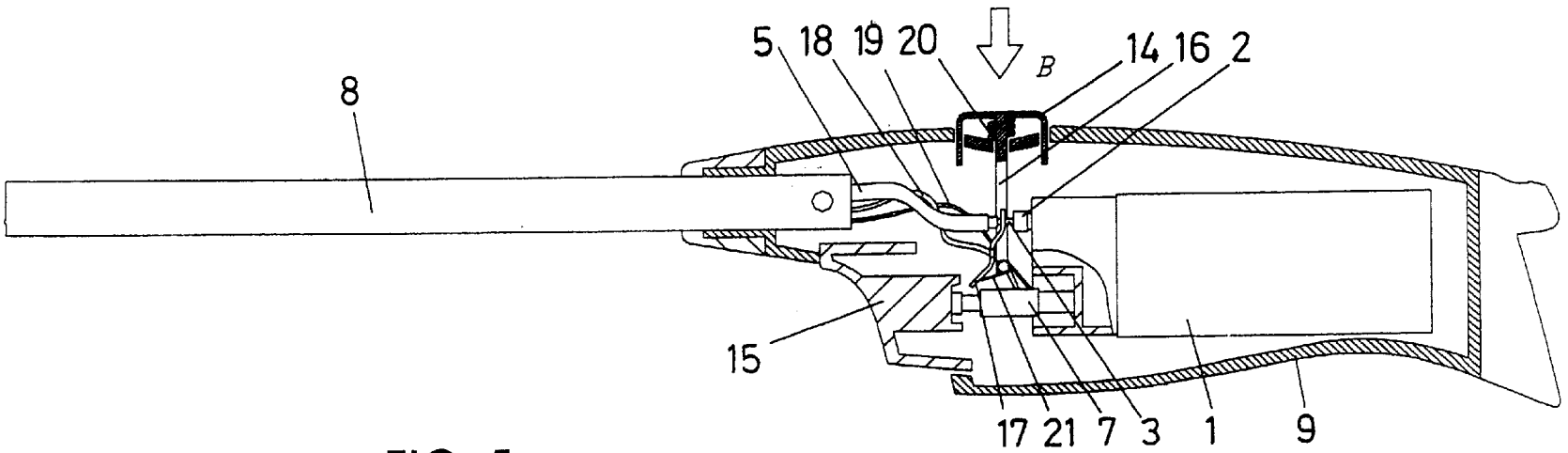
FIGS. 5 and 5A show simplified representations of the operating mechanism with the disabling safety mechanism in its dormant position without a finger pressing the main push-button.
Figure 5A:
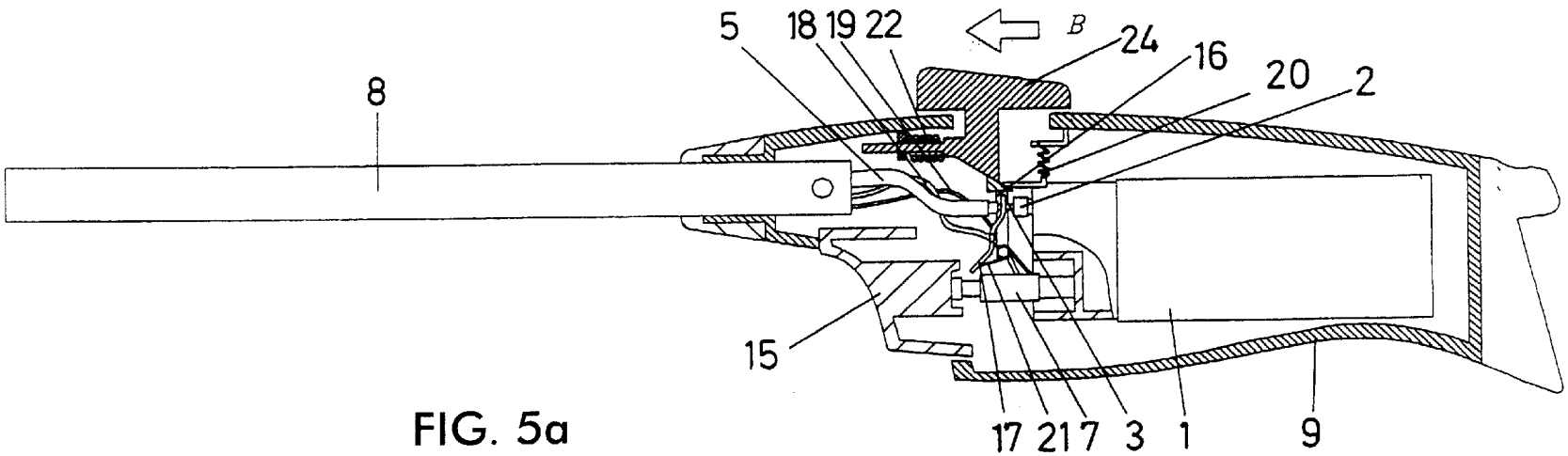
Figure 6:
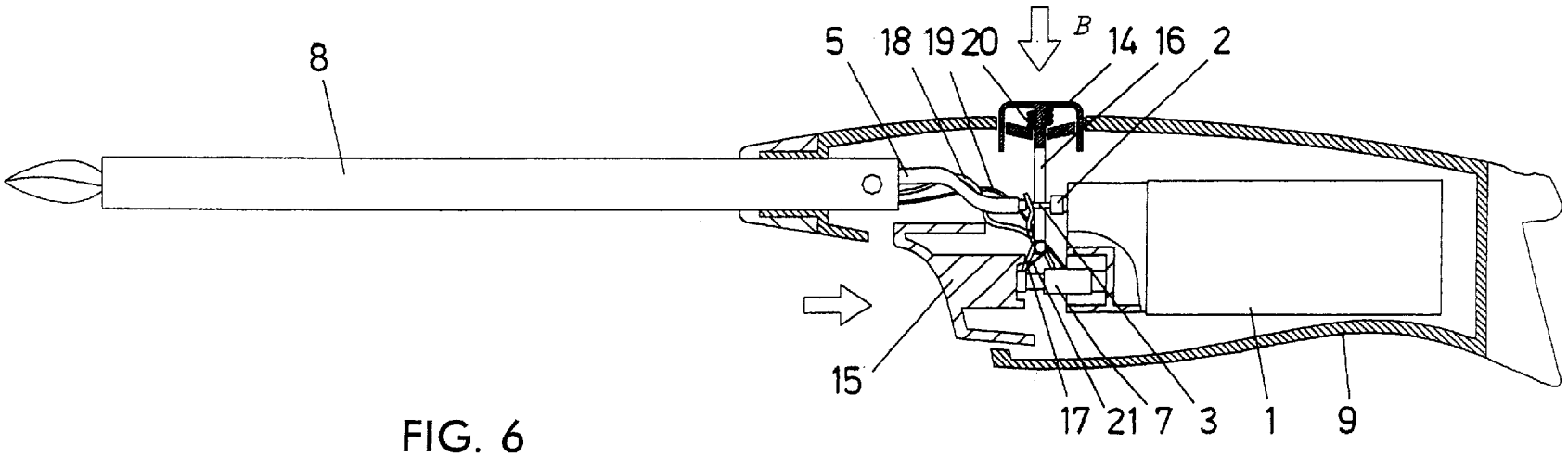
FIGS. 6 and 6A show simplified representations of the operating mechanism with the disabling safety mechanism in its dormant position and a finger pressing the main push-button. In this situation ignition occurs.
Figure 6A:
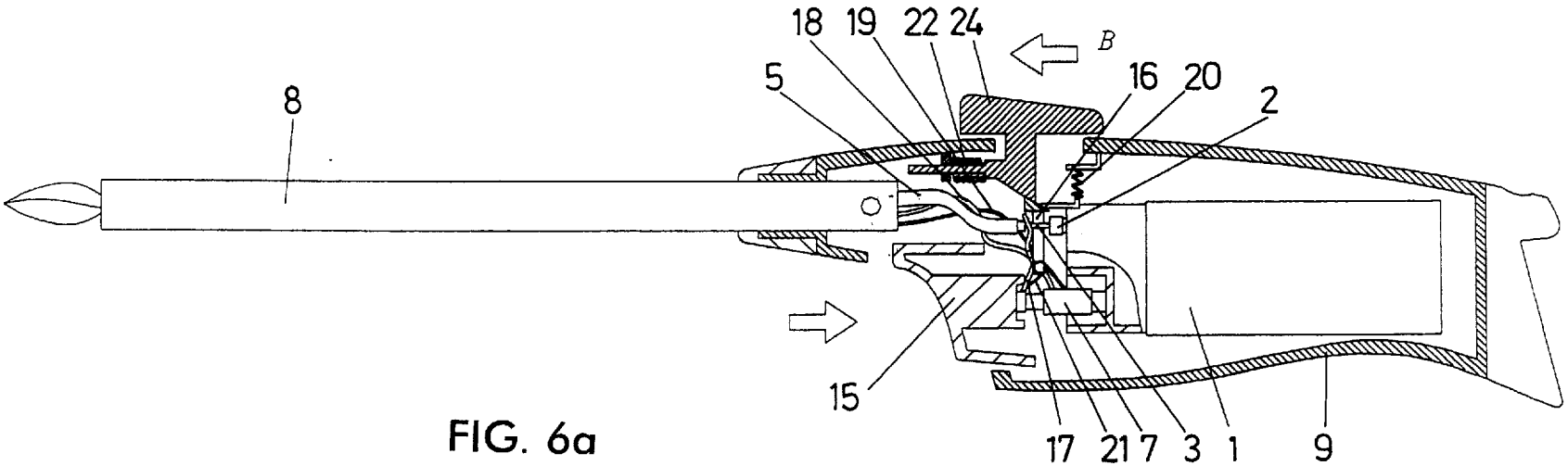

In the lighter outlined in this invention, as well as the elements described above there is a novel element (14) that fulfils the role of a second push-button arming and disabling the safety mechanism of the lighter and is based on a track mechanism (16), which is dependent on the steady, armed position (A) thanks to a spring (20). When the finger is not pressing this push-button (14), FIGS. 3 and 3A and FIGS. 4 and 4A, the point of support of the lever mechanism formed by the tilting (17) does not come into contact with the push-button itself (14) and so does not exert any force on the tilting (17) and as a consequence no power is transmitted between the push-button (15) and the valve (2), with the result that the valve stays closed despite the fact that the actual tilting can still move. Under such circumstances the push-button acts as a piezoelectric generator (7) creating a voltage arc between the electrodes; the absence of gas in the combustion chamber means that ignition is impossible. When the finger exerts pressure on the push-button (14) the safety mechanism is disabled, position (B), FIGS. 5 and 5A and FIGS. 6 and 6A, the point of support of the lever mechanism formed by the tilting (17) comes into contact with the push-button itself (14), thereby generating reaction force on the tilting (17) and as a consequence force and movement are transmitted between the push-button (15) and the valve (2), with the result that the valve remains open. Under these circumstances the fuel in the combustion chamber is ignited, generating a flame whose characteristics are regulated by the geometry of the combustion chamber, the burner (6) and the regulating valve (2).

A second spring (21) positions the tilting element (17) in such a way that the latter's fulcrum is kept separate from the sliding mechanism (16) to avoid any interference with it.

In the lighter outlined in this invention the operating force of the secondary push-button (14) can be adjusted to the pressure necessities of the finger so that the track mechanism (16) moves when operated by an adult and does not move when operated by a child, whose force is limited by its physiological characteristics; moreover, to operate the system a series of movements is required in which the secondary push-button (14) must be operated before the main push-button (15). As a consequence the invention is original in that it requires a certain force and a specific sequence of movements to operate it.

Furthermore, and unlike other safety systems currently available on the market, which are based on mechanisms mechanically more complex, this mechanism is reliable thanks to the simple nature of its operation.

Figure 1A:
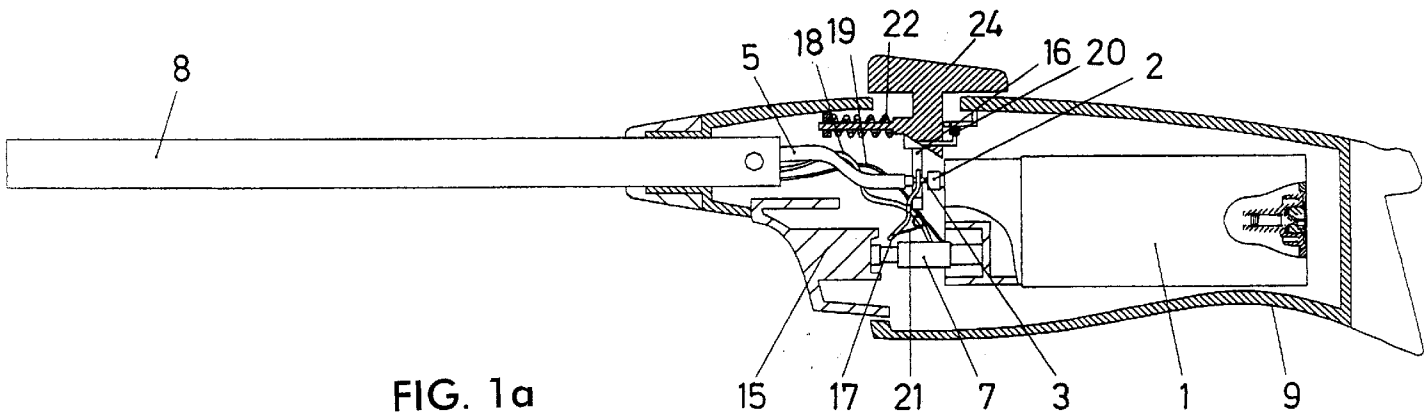
Figure 2:
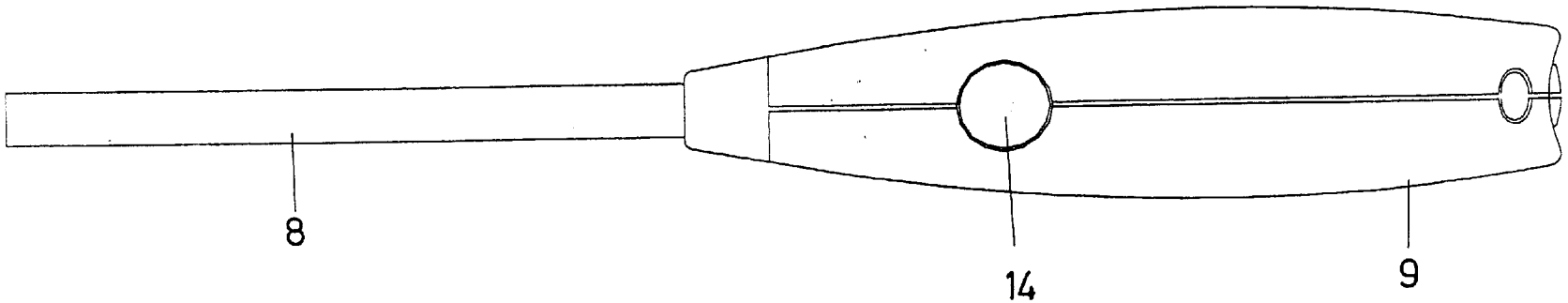
FIGS. 2 and 2A show two schematic views of the invention perpendicular to the one above.
Figure 2A:
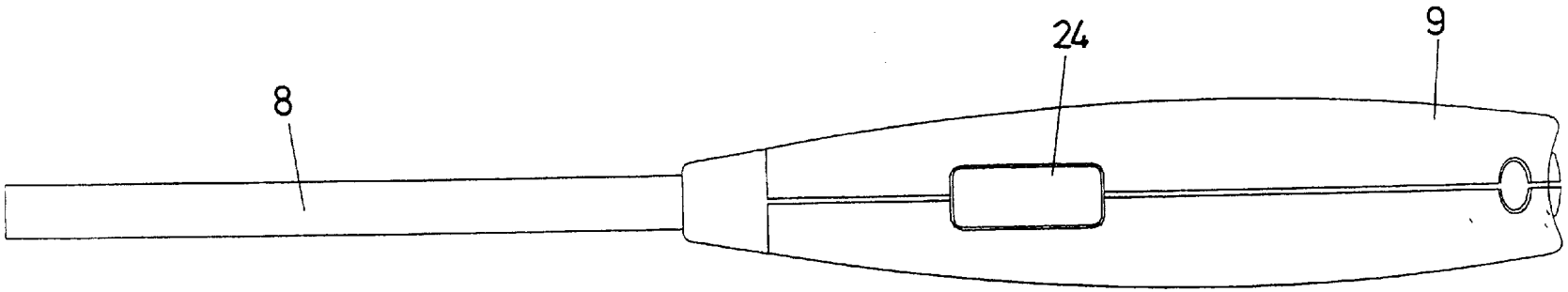

In a variation of the embodiment of the device, the switch (14) which moves parallel to the track mechanism (16) is replaced by a switch (24) which moves substantially perpendicular to the track mechanism (16), as shown in FIGS. 1*a*, 2*a*, 3*a*, 4*a*, 5*a*, 6*a*, in which a spring (22) is provided to bias the switch (24) into a state in which the lighter is inactive. The inside end of the switch (24) terminates in a triangular cam which, together with the other triangular cam at the end of the upper end of the track mechanism (16), coverts the longitudinal movement switch (24) into movement of the track mechanism (16) substantially perpendicular to that of switch (24).

What is claimed is:

1. A lighter, comprising:

a fuel tank for containing a flammable gas;

a valve operable for selectively opening and closing the fuel tank;

a combustion chamber coupled to the valve for receiving the flammable gas from the fuel tank when the valve is opened;

a burner positioned in the combustion chamber for igniting the flammable gas;

a push-button;

a tilting lever having a first end and a second end, the first end of the tilting lever cooperating with the push-button and the second end of the tilting lever cooperating with the valve;

a track mechanism selectively slidable along an axis into one of an enabling position in which the track mechanism is positioned for defining a fulcrum to support the tilting lever to tilt to open the valve to the fuel tank when the push-button is depressed and a disabling position in which the track mechanism is positioned not to support the tilting lever and not to define the fulcrum so that the valve to the fuel tank remains closed when the push-button is depressed; the push-button being depressable when the track mechanism is selectively slid into either the enabling or disabling position; and a piezoelectric generator operable to generate a voltage arc within the combustion chamber to ignite the flammable gas when the push-button is depressed.

2. The lighter of claim 1, further comprising a body for containing the fuel tank, the valve, the tilting lever, and the piezoelectric generator.

3. The lighter of claim 2, further comprising a tube at the body and coupled to the valve, the tube forming the combustion chamber.

4. The lighter of claim 2, wherein the body includes an upper face, the push-button being positioned on the upper face of the body.

5. The lighter of claim 2, wherein the body includes a side face, the push-button being positioned on the side face of the body.

6. The lighter of claim 1, further comprising a second push-button coupled to the track mechanism for selectively placing the track mechanism into one of the enabling and disabling positions.

7. The lighter of claim 6, wherein the body includes an upper face, the second push-button being positioned on the upper face of the body.

8. The lighter of claim 6, wherein the body includes an side face, the second push-button being positioned on the side face of the body.

9. The lighter of claim 6, wherein the second push-button is configured to be selectively slid along a second axis substantially parallel to the axis of the track mechanism.

10. The lighter of claim 9, wherein the track mechanism is operable only when a force exceeding a predetermined operating force is applied to the second pushbutton, whereby accidental activation is prevented.

11. The lighter of claim 6, wherein the second push-button is configured to be selectively slid into one of the enabling and disabling positions along a second axis substantially perpendicular to the axis of the track mechanism.

12. The lighter of claim 11, wherein the track mechanism is operable only when a force exceeding a predetermined operating force is applied to the second pushbutton, whereby accidental activation is prevented.

* * * * *